US010492576B2

(12) United States Patent
Lin

(10) Patent No.: US 10,492,576 B2
(45) Date of Patent: Dec. 3, 2019

(54) AUTOMATIC WOBBLE JEWELRY APPARATUS AND A SETTING METHOD THEREOF

(71) Applicant: Shenzhen Y&M Jewelry Co., Ltd., Shenzhen (CN)

(72) Inventor: Tianwei Lin, Shenzhen (CN)

(73) Assignee: SHENZHEN Y&M JEWELRY CO., LTD., Shenzhen (CN)

( * ) Notice: Subject to any disclaimer, the term of this patent is extended or adjusted under 35 U.S.C. 154(b) by 51 days.

(21) Appl. No.: 15/704,655

(22) Filed: Sep. 14, 2017

(65) Prior Publication Data

US 2018/0338590 A1 Nov. 29, 2018

(30) Foreign Application Priority Data

May 24, 2017 (CN) ..... 2017 1 0373731

(51) Int. Cl.
*A44C 17/04* (2006.01)
*A44C 17/02* (2006.01)

(52) U.S. Cl.
CPC ..... *A44C 17/0275* (2013.01); *A44C 17/04* (2013.01)

(58) Field of Classification Search
CPC .. A44C 17/0258; A44C 17/0275; A44C 17/04
See application file for complete search history.

(56) References Cited

U.S. PATENT DOCUMENTS 6,857,289 B1 * 2/2005 Cheng ..... A44C 17/0275 63/26
2003/0172673 A1 * 9/2003 Kimura ..... A44C 17/0275 63/29.1

* cited by examiner

*Primary Examiner* — Jack W Lavinder
(74) *Attorney, Agent, or Firm* — Anova Law Group, PLLC

(57) ABSTRACT

The present invention provides an automatic wobble jewelry apparatus and setting method thereof, due to arranging two connection grooves in two sides of the body, to placing the connection shaft, where a barrier sidewall is arranged opposite to the connection shaft, to limiting the subpart a wobble range between left and right, and avoid effectively unnecessary wobbles, before avoiding any abrasions caused by the wobbles between them, after a long-term usage, the connection shaft will not get stuck in the connection groove, thus lose the ability of wobbling, instead it may keep the effect of wobbling for a long time, so as to ensure a long-term brilliance effect and extend the service life. The present invention further comprises a cover plate for closing the connection groove and visually making the diamond look larger and more brilliant.

17 Claims, 12 Drawing Sheets

AUTOMATIC WOBBLE JEWELRY APPARATUS AND A SETTING METHOD THEREOF

CROSS-REFERENCES TO RELATED APPLICATIONS

This application claims the priority of Chinese patent application no. 201710373731.4, filed on May 24, 2017, the entire contents of all of which are incorporated herein by reference.

FIELD OF THE INVENTION

The present invention relates to the field of a jewelry apparatus and a method thereof, and, more particularly, to an automatic wobble jewelry apparatus and a setting method thereof.

BACKGROUND

With a higher and higher requirement for jewelry, a jewelry with an ordinary single part, due to a dull arrangement, a fixed shape and a limited brilliance effect thereof, has not been able to meet people's demand any more, in prior art, there has been a design of adopting an arrangement of an automatic wobble jewelry to improve an automatic wobble frequency of a subpart, so as to improve the brilliance effect of the jewelry apparatus.

However, there is a plurality of defects in the automatic wobble jewelry apparatus, since a connection shaft keeps touching an inner wall of a shaft hole, a long-term wobble may lead to a heavy wear between the connection shaft and the shaft hole, after the connection shaft has been worn down, a wobble effect of the automatic wobble jewelry may be affected, thus the brilliance effect of the automatic wobble jewelry apparatus may be affected; also, if the connection shaft is worn, the shaft hole may form a gap in the inner wall thereof, causing the connection shaft to be stuck in the gap, which may further cause the automatic wobble jewelry apparatus stop wobbling, thus affecting a service life and a long-term usage effect of the automatic wobble jewelry. Also, if there is an overlarge inclination angle or a vibration, a wobble subpart in a middle may lose an ability of wobbling, due to the connection shaft getting stuck in the shaft hole.

Therefore, the prior art needs to be improved and developed.

BRIEF SUMMARY OF THE DISCLOSURE

According to the above described defects, the purpose of the present invention is providing an automatic wobble jewelry apparatus and setting method thereof, in order to solve the problems in the prior art that, in an automatic wobble jewelry apparatus, the connection shaft and the shaft hole are wearing each other, causing the service life of the automatic wobble jewelry apparatus shorten and affecting the long-term effect of wobbling, as well as an effect of getting stuck when the wobble is overlarge.

In order to achieve the above mentioned goals, the technical solution of the present invention to solve the technical problems is as follows:

An automatic wobble jewelry apparatus, comprises a body, where a subpart is arranged inside, and a space is arranged in the body, applied for the subpart to wobbling, a connection shaft is set extending on each of two sides of the subpart, wherein the automatic wobble jewelry apparatus further comprises:

a connection groove, arranged in each of two inner sides of the body, applied to placing the connection shaft for connecting the subpart;

a barrier sidewall, arranged in the connection groove, at a position opposite to the connection shaft, applied to limiting the subpart a wobble range between left and right;

a cover plate, applied to closing the connection groove.

The automatic wobble jewelry apparatus, wherein the connection shaft owns a first blade;

the first blade is applied to adapting the connection groove, to facilitate the subpart to wobble.

The automatic wobble jewelry apparatus, wherein an end of the connection shaft is arranged as a tip, a distance from the tip to the barrier sidewall is arranged to keep a smaller gap.

The automatic wobble jewelry apparatus, wherein the connection groove is arranged in a C-shape, and a barrier part is arranged at an opening thereof, applied to avoiding the connection shaft from falling off.

The automatic wobble jewelry apparatus, wherein the cover plate has a plurality of rings of cutting faces of inner and outer concentric circles.

The automatic wobble jewelry apparatus, wherein the cutting face is a single cutting face or a multi-cutting face.

The automatic wobble jewelry apparatus, wherein a rear side of the body further has a through hole arranged for light transmitting.

The automatic wobble jewelry apparatus, wherein the body further has a pendant connection ring arranged.

Any of the automatic wobble jewelry apparatus setting method according to any one above, wherein it comprises a plurality of following steps:

S100: placing the connection shaft of the subpart into the connection groove in the body accordingly and respectively;

S200: placing the cover plate onto the body, to close the connection groove;

S300: connecting the cover plate and the body fixedly.

The automatic wobble jewelry apparatus setting method, wherein the cover plate and the body in the step S300 are fixedly connected by adopting a laser welding method.

Comparing to the prior arts, the present invention provides an automatic wobble jewelry apparatus and a setting method thereof, wherein the automatic wobble jewelry apparatus adopts two connection grooves arranged in two sides of the body, where a barrier sidewall is arranged opposite to the connection shaft, the barrier sidewall is applied to limiting the subpart a wobble range between left and right, which is able to avoid effectively any unnecessary wobbles to left and right between the connection shaft and the connection groove, so as to avoid any abrasions caused by the wobbles between the connection shaft and the connection groove, during a long-term usage, the connection shaft will not get stuck in the connection groove, and lose the ability of wobbling, which is able to keep the effect of wobbling for a long time, so as to ensure a long-term brilliance effect. It also extends the service life of the automatic wobble jewelry apparatus. The automatic wobble jewelry apparatus further comprises a cover plate applied to closing the connection groove, the cover plate is able to make the diamond look larger and more brilliant.

DETAILED DESCRIPTION OF EMBODIMENTS

The present invention provides an automatic wobble jewelry apparatus and the setting method thereof, in order to make the purpose, technical solution and the advantages of the present invention clearer and more explicit, further detailed descriptions of the present invention are stated here, referencing to the attached drawings and some preferred embodiments of the present invention. It should be understood that the detailed embodiments of the invention described here are used to explain the present invention only, instead of limiting the present invention. An automatic wobble jewelry apparatus is applied more commonly, but not limited, to a diamond setting jewelry; it may also be applied to other jade inlaid jewelry apparatus, including a sapphire, a ruby and more. A preferred embodiment of the jewelry apparatus according to the present invention is mainly, but not limited to, a pendant, shown as FIGS. 1-3, it may also be applied to other jewelry apparatuses including a ring or an earring.

Figure 1:
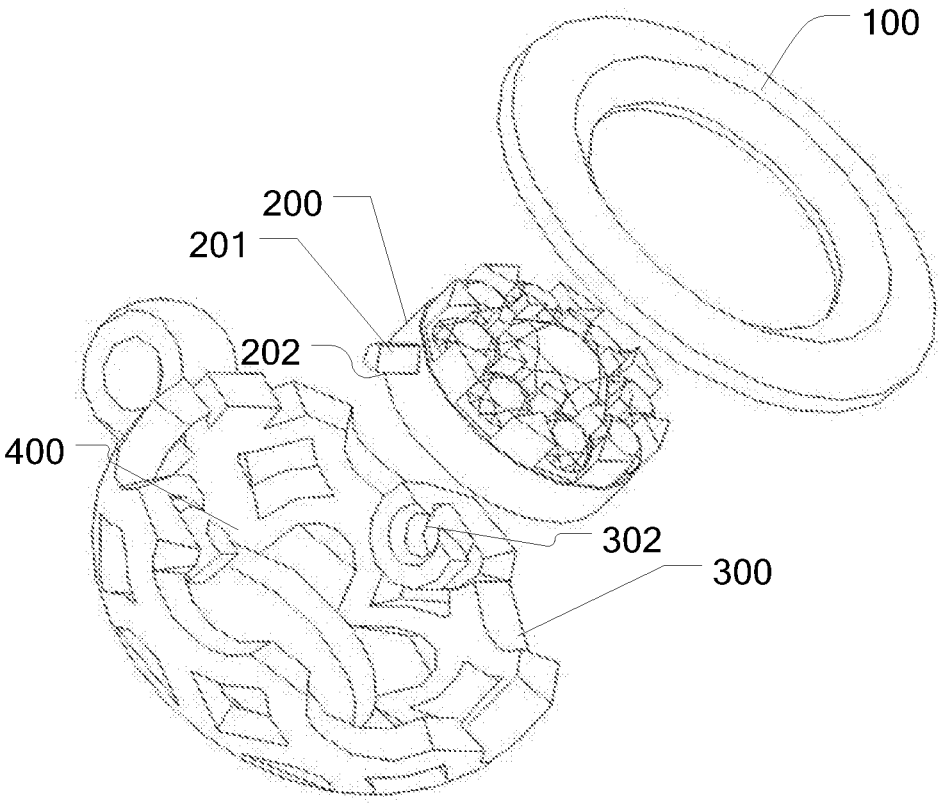
FIG. 1 illustrates an explored diagram of a preferred embodiment of the automatic wobble jewelry apparatus according to the present invention.
Figure 2:
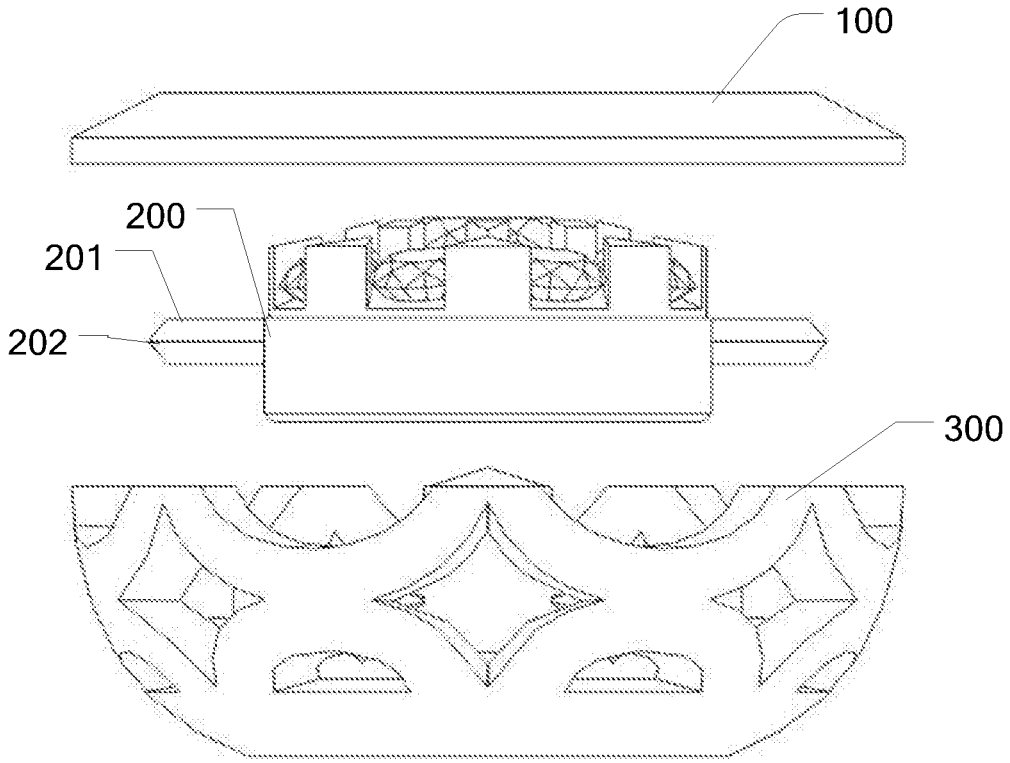
FIG. 2 illustrates an explored front view diagram of a preferred embodiment of the automatic wobble jewelry apparatus according to the present invention.
Figure 3:
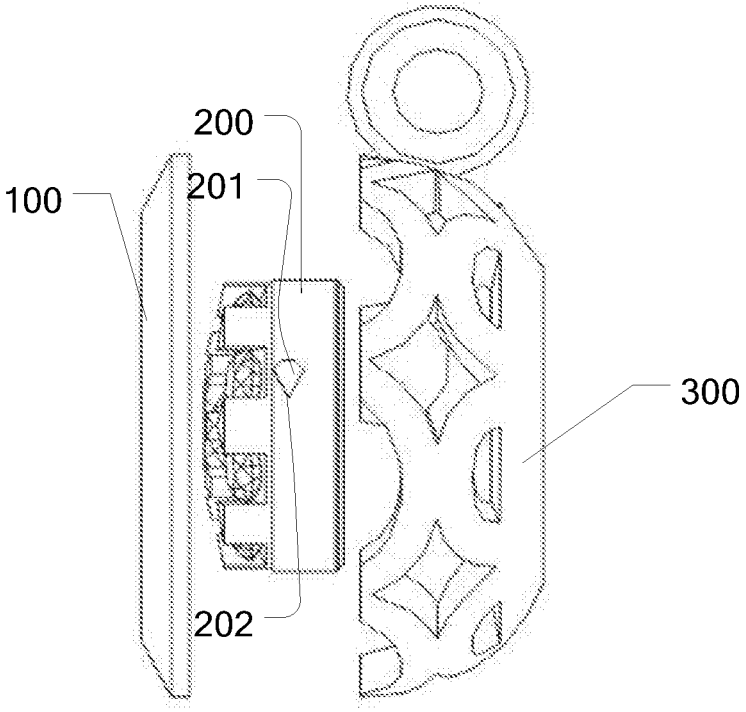
FIG. 3 illustrates an explored side view diagram of a preferred embodiment of the automatic wobble jewelry apparatus according to the present invention.

An explored schematic diagram in a different view angle on a preferred embodiment according to the present invention is shown from FIG. 1 to FIG. 3, the automatic wobble jewelry apparatus comprises a body 300, a subpart 200, and a space 400 arranged in the body, applied for the subpart to shaking, the space 400 may be a dent or a through hole arranged in the body, which is large enough to facilitate the subpart 200 to wobble and to be set.

Each of two sides of the subpart 200 has a connection shaft 201 arranged, as shown in FIG. 1, FIG. 2 and FIG. 3, the connection shaft 201 may be assembled and designed to a preset angle including a position relationship between a gravity center of the subpart and the connection shaft 201, according to a wobble degree of the subpart, the connection shaft 201 has a first blade 202 arranged, the first blade 202 is applied to achieving a wobble effect of the subpart 200, through an adaptation between the first blade 202 and the opposite connection groove 302 in the body, it is able to keep an effect of the subpart shaking constantly. Due to the gravity center of the subpart 200 keeping biased from the connection line of the connection shaft 201 in the subpart 200, which is biased to a side of the first blade, thus it is able to achieve an automatic wobble from the subpart.

Figure 4:
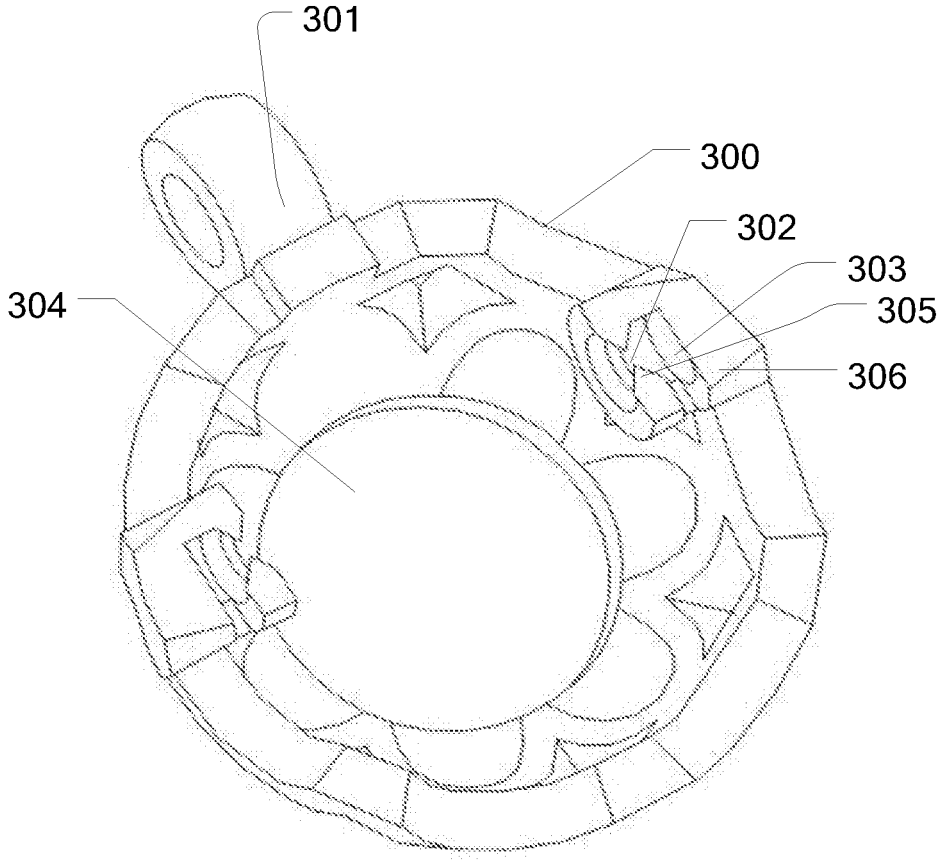
FIG. 4 illustrates a cubic diagram on the body of a preferred embodiment of the automatic wobble jewelry apparatus according to the present invention.
Figure 5:
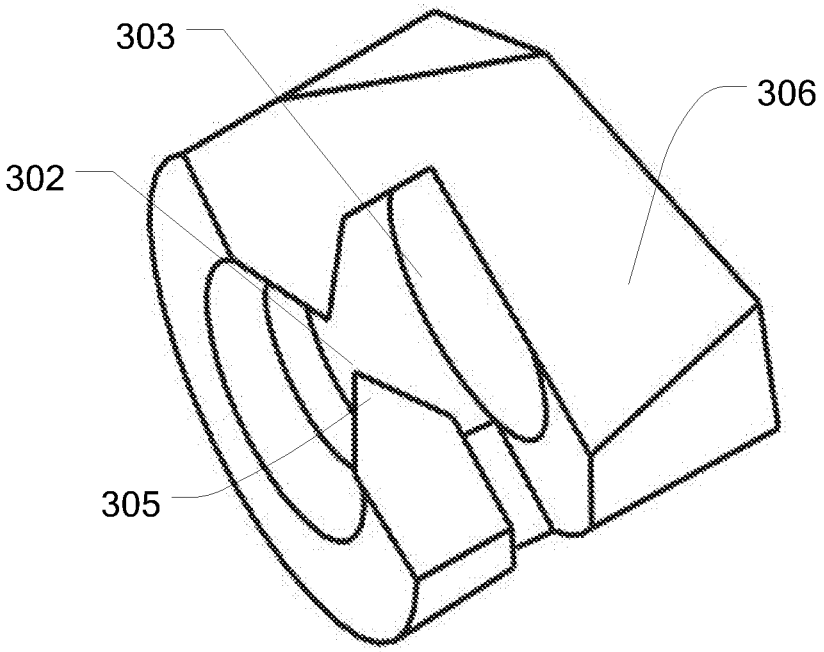
FIG. 5 illustrates a partial enlarged view on the connection groove of a preferred embodiment of the automatic wobble jewelry apparatus according to the present invention.
Figure 6:
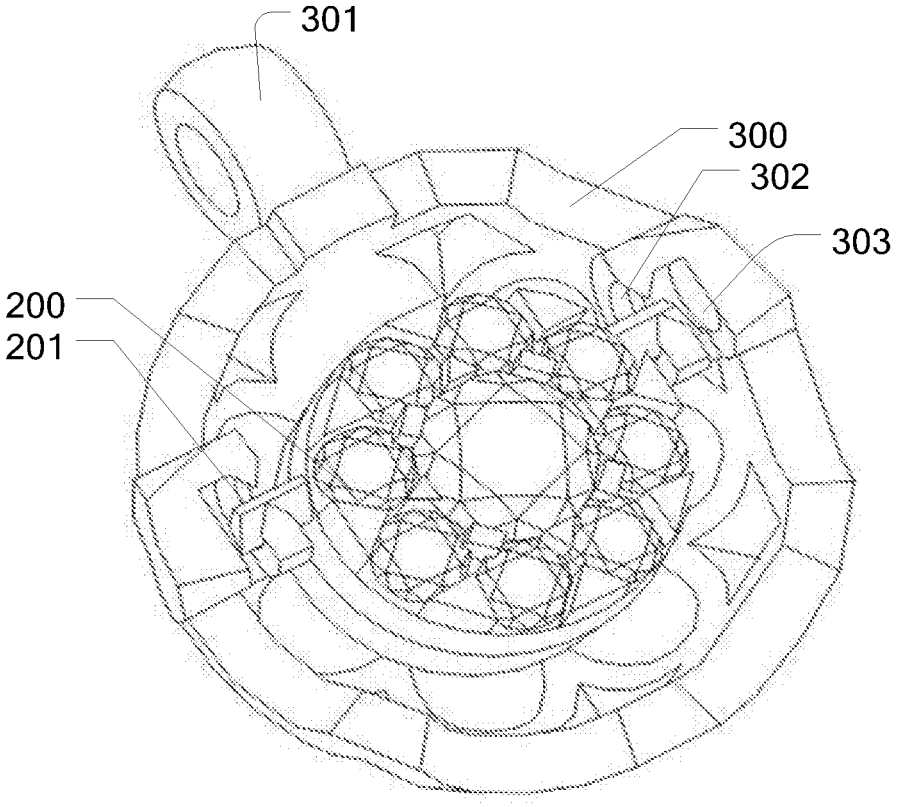
FIG. 6 illustrates an assembly schematic diagram of a preferred embodiment of the automatic wobble jewelry apparatus according to the present invention.

Each of two inner sides of the body 300 further has a connection groove 302 arranged, shown as FIG. 1, FIG. 4 and FIG. 5, the connection groove 302 may form directly a hole in the body 300, however, a more preferred embodiment is set into a C-shape. Referencing to FIGS. 4, 5 and 6 together, placing the connection shaft 201 into the connection groove 302, while two connection shafts 201 are placed into the C-shaped dent of the connection groove 302 simultaneously, the first blade 202 of the connection shaft 201 may touch an inner wall of the connection groove 302, in such a way, the subpart 200 may connect to the body 300, through placing the connection shaft 201 into the connection groove 302, and keeping the first blade 202 touching and connecting to the inner wall of the connection groove 302, thus realizing a pretty small resistance between the subpart 200 and the body 300, and achieving a long-term shaking of the subpart 200 on the body, as well as increasing a brilliance effect of the diamond in the subpart 200, while the shaking of the subpart 200 increases a visual display effect. As long as the first blade 202 is kept in a touching state, the shaking effect of the subpart 200 may be kept.

A benefit of arranging the connection groove 302 in a C-shape is, facilitating to assemble the connection shaft 201 and the subpart 200. On one side of the connection groove 302, there is a barrier sidewall 303, as shown in FIG. 4, the barrier sidewall 303 is applied to limiting the connection shaft 201 a wobble range between left and right in the connection groove 302, thus, a gap between the barrier sidewalls 303 on two sides of the body, is equal to or a little larger than that between two tips of the two connection shafts 201. It should be ensuring a smaller gap between the tips of the connection shaft 201 on a same side and the barrier sidewall 303, without effecting a front and rear shaking of the connection shaft 201, in such a way, since the wobble in left and right between the connection shaft 201 and the connection groove 302 is decreased, an abrasion in between is also decreased, while the subpart 200 and the connection shaft 201 thereof may be kept not moving to left and right too much, thus avoiding getting stuck and losing a function of wobble, which may not only extend the service life of the automatic wobble jewelry apparatus, but also ensure the wobble effect in use, while it will not cause the automatic wobble jewelry apparatus not being able to shake any more, since the connection shaft gets stuck in the gap of the connection groove due to the abrasions in between; or due to an over abrasion of a touch point position in the connection shaft touching the first blade 202, making the first blade 202 and the connection groove 302 no more keeping a point touch, thus not be able to keep an original wobble effect.

Preferably, an end of the connection shaft 201 may further be arranged as a tip, in order to further decrease a touching area in the wall of the barrier sidewall 303, so as to decrease a friction and increase the wobble of the subpart 200. A cutting face 306 is further arranged at an opening of the C-shaped connection groove 302, facilitating to match a cover plate 100, before applied to closing the connection shaft 301 into the connection groove 302. The cutting face 306 may be formed by machining and cutting, may also be formed by punching, so as to facilitate an assembly process of the subpart 200: after placing the connection shaft 201 into the connection groove 302 easily, covering the cover plate 100 to close the connection groove 302, and making a simpler and easier assembly. A smaller opening is further arranged next to the opening of the connection groove 302, so as to form a barrier part 305, applied to avoiding the connection shaft 201 from falling off, shown as FIG. 5.

Figure 11:
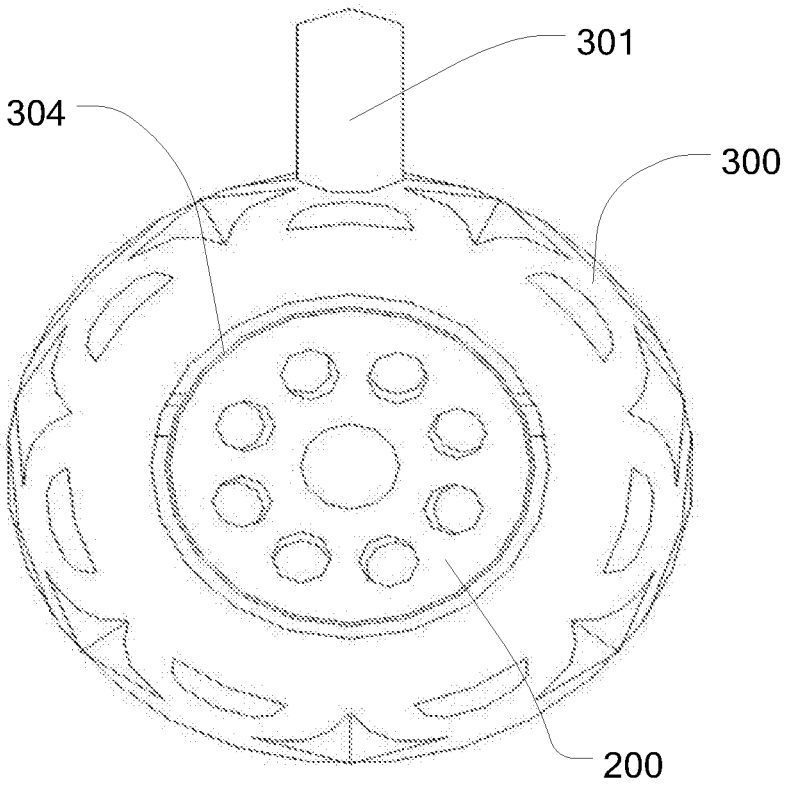
FIG. 11 illustrates a rear view of a preferred embodiment of the automatic wobble jewelry apparatus according to the present invention.

The body 300 further comprises a pendant connection ring 301 for connecting a plurality of other parts including a necklace or a bracelet, as shown in FIG. 4 and FIG. 11, there is a through hole 304 in a bottom of the body 300, the through hole 304 may be applied to transmitting light, which facilitates to increase a brilliance effect of the jewelry; In order to make the diamond look more brilliant, the body 300 may be designed to a hollow structure, on one hand, it is able to increase a design of aesthetic, on the other hand, it may be used for light transmission, and make the diamond look more brilliant. The light may pass through the through hole 304 and the hollow structure before entering an inner space of the body 300, making the diamond look more brilliant.

Figure 7:
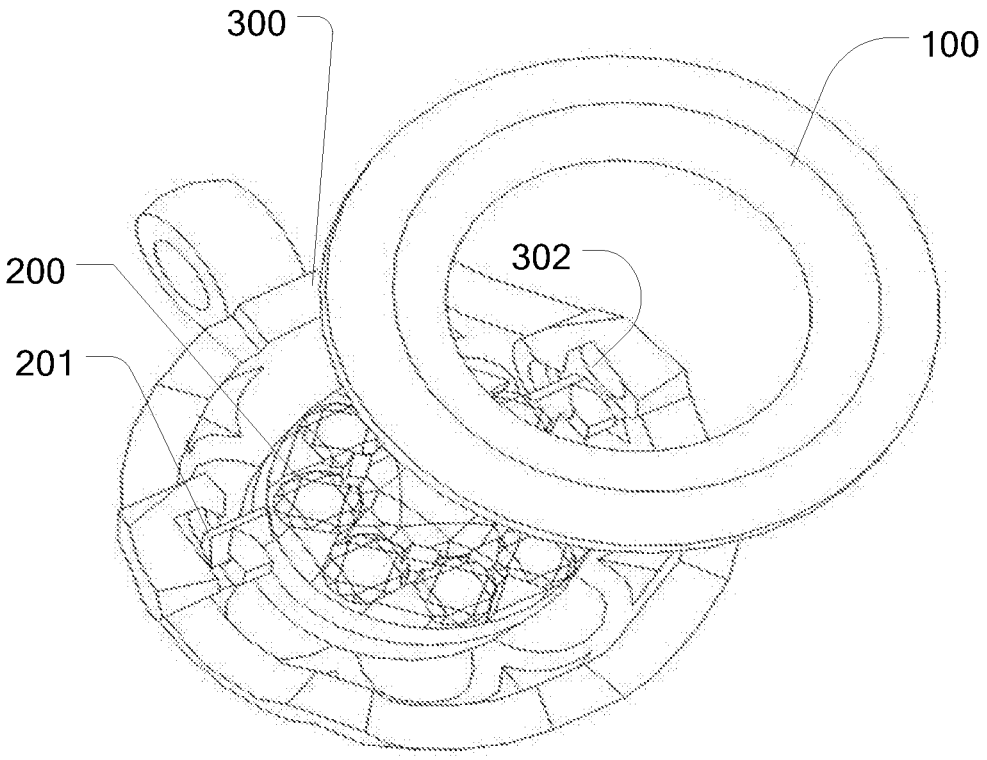
FIG. 7 illustrates an explored assembly diagram of a preferred embodiment of the automatic wobble jewelry apparatus according to the present invention.
Figure 8:
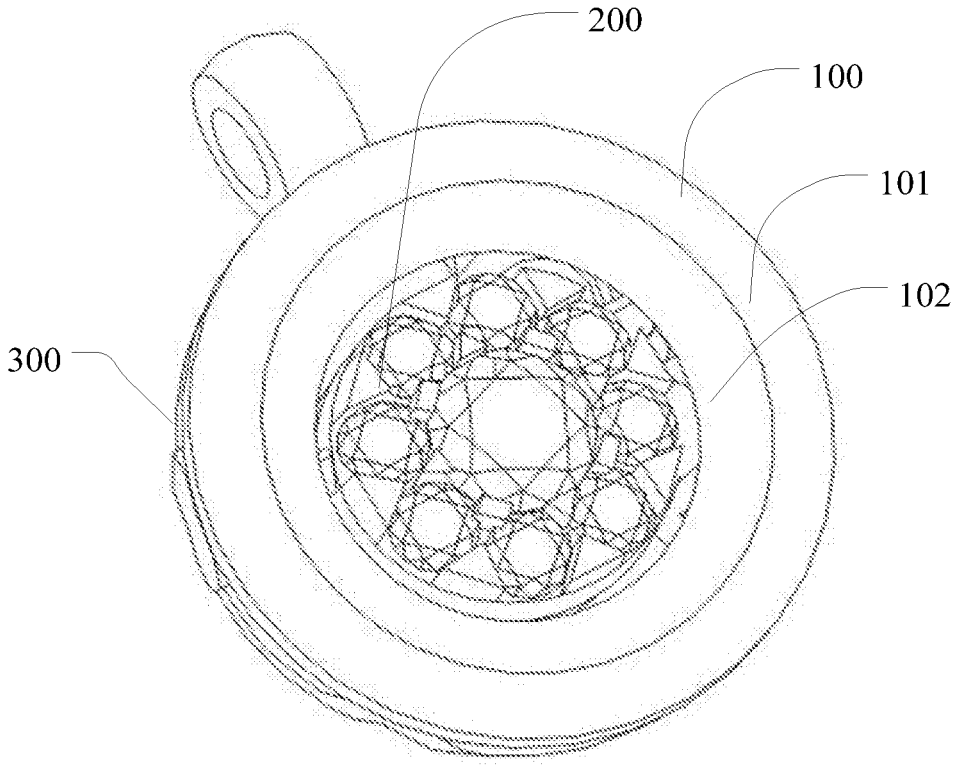
FIG. 8 illustrates a cubic diagram after assembling of a preferred embodiment of the automatic wobble jewelry apparatus according to the present invention.
Figure 9:
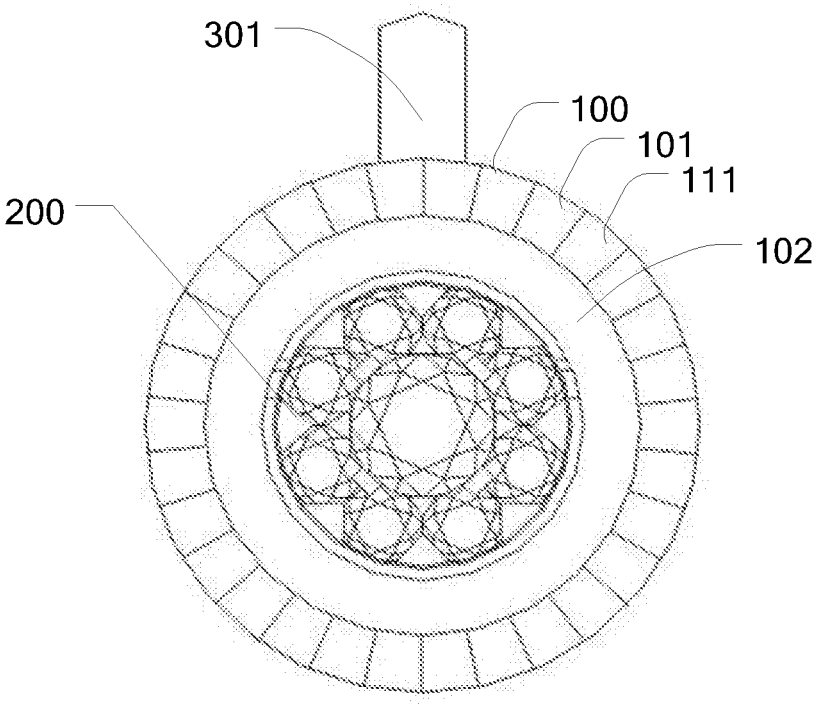
FIG. 9 illustrates a front view diagram of another preferred embodiment of the automatic wobble jewelry apparatus according to the present invention.
Figure 10:
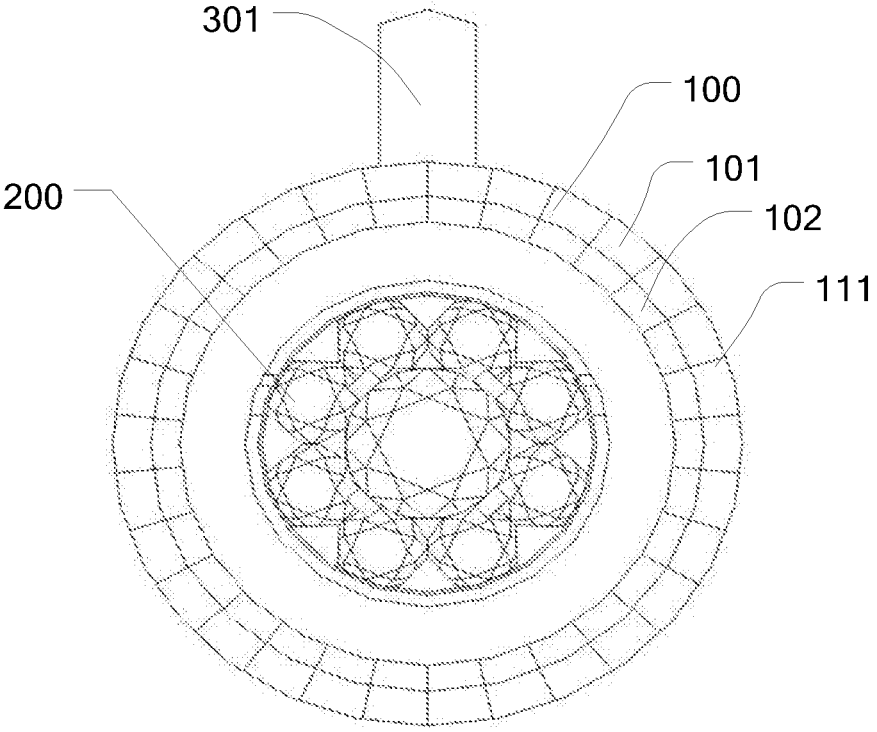
FIG. 10 illustrates a front view diagram of a third preferred embodiment of the automatic wobble jewelry apparatus according to the present invention.

The automatic wobble jewelry apparatus further comprises a cover plate 100 applied to closing the opening of the connection groove 302, as shown in FIG. 7, covering the cover plate 100 onto the body 300, both the cover plate 100 and the body 300 may be connected by laser welding. The cover plate 100 may arrange more cutting faces, a cutting face may be a single cutting face or a multi-cutting face, shown as FIG. 8, there are two concentric cutting faces on the cover plate 100, i.e., an outer concentric cutting face 101 and an inner concentric cutting face 102, respectively. As shown in FIG. 9, a plurality of longitudinal cutting faces 111 may further be arranged on the outer concentric cutting face 101 in the cover plate; as shown in FIG. 10, the outer concentric cutting face 101 and the inner concentric cutting face 102 of the cover plate 100 may both arrange a plurality of longitudinal cutting faces 111; in such a way, different cutting faces are arranged on the surfaces of the cover plate 100, which are applied to reflecting light, on one hand, they may close the connection groove 302 to avoid the connection shaft 201 falling off from the connection groove 302; on another hand, due to setting the cutting faces on the cover plate, the brilliance effect may be enhanced, and the diamond may look larger and more brilliant.

Figure 12:
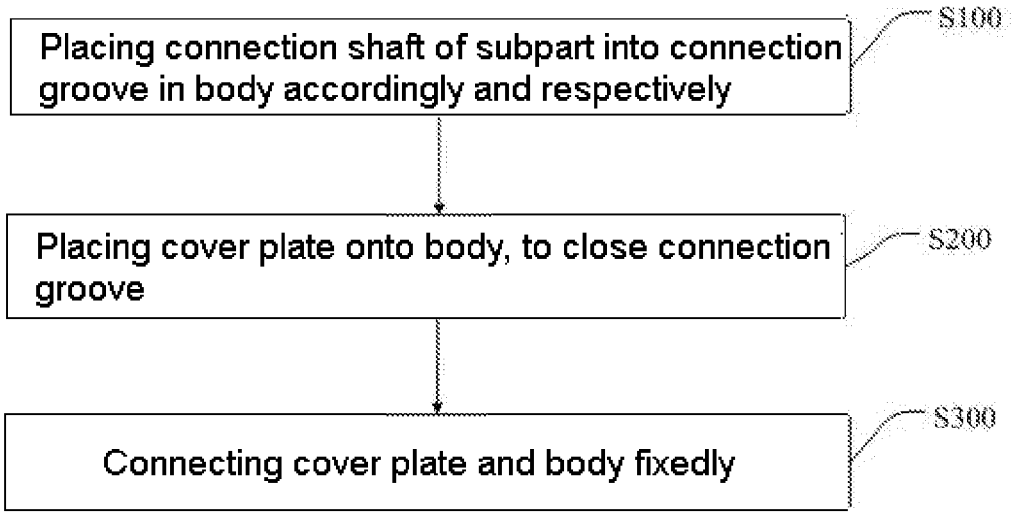
FIG. 12 illustrates a flow chart on the automatic wobble jewelry apparatus setting method of a preferred embodiment according to the present invention.

The present invention further provides a setting method for the automatic wobble jewelry apparatus, as shown in FIG. 12, which illustrates a flow chart of an embodiment, the setting method of the automatic wobble jewelry apparatus comprises a plurality of following steps:

S100: Referencing to FIG. 6, placing the connection shaft of the subpart into the connection groove in two sides of the body accordingly and respectively; and making the first blade 202 touch inside of the connection groove 302.

S200: Referencing to FIG. 7, placing the cover plate onto the body, to close the opening of the connection groove 302.

S300: Fixedly connecting the cover plate and the body, which may be fixedly connected by a method of laser welding.

The setting method is very convenient and simple to operate, which is easier to achieve a manufacturing process of the automatic wobble jewelry apparatus, both the specific technical protocol and the technical effect have been described in details in the automatic wobble jewelry apparatus, thus no more detailed contents will be described here.

The present invention adopts a method of arranging the connection grooves and the barrier sidewalls on two sides of the body, by setting the barrier sidewalls, it limits the wobble range of the connection shaft between left and right, which is able to avoid effectively any unnecessary wobbles between the connection shaft and the connection groove, so as to avoid any unnecessary abrasions, and, even after a long-term usage, the wobble effects are not affected, it also extends the service life of the automatic wobble jewelry apparatus, while avoids a problem that the subpart gets stuck due to any excessive wobbles. The present invention further adopts a cover plate, the cover plate may not only close the connection groove to avoid the connection shaft falling off from the connection groove, but also make the diamond look larger and more brilliant, due to the cover plate owning a glaring effect.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. An automatic wobble jewelry apparatus comprising:

a body;

a subpart arranged inside the body; and a space formed in the body for the subpart to wobble in the space, wherein:

two connection shafts are extending from each of two sides of the subpart; two connection grooves are formed in each of two inner sides of the body to receive the two connection shafts for connecting the subpart, each of the two connection grooves is formed in a C-shape having an opening, and a width of the opening is smaller than a diameter of each of the two connection grooves;

for each of the two connecting grooves, a barrier sidewall is formed on one side of the connection groove at a position opposite to the corresponding connection shaft to limit a move range of the subpart;

a cover plate is applied to close the two connection grooves.

2. The automatic wobble jewelry apparatus according to claim 1, wherein each of the two connection shafts comprises a first blade-shaped edge; and the first blade-shaped edge is configured to be adapted in the connection groove.

3. The automatic wobble jewelry apparatus according to claim 2, wherein an end of each of the two connection shafts is formed as a tip.

4. The automatic wobble jewelry apparatus according to claim 3, wherein a barrier part is arranged at the opening of the C-shape to prevent each of the two connection shafts from falling off the opening.

5. The automatic wobble jewelry apparatus according to claim 4, wherein the cover plate has a plurality of rings having a cutting face of inner and outer concentric circles.

6. The automatic wobble jewelry apparatus according to claim 5, wherein the cutting face is a single-cutting face or a multi-cutting face.

7. The automatic wobble jewelry apparatus according to claim 4, wherein a rear side of the body further has a through hole arranged for light transmission.

8. The automatic wobble jewelry apparatus according to claim 4, wherein the body further has a pendant connection ring for connecting a necklace or a bracelet.

9. An automatic wobble jewelry apparatus setting method for setting an automatic wobble jewelry apparatus, comprising: placing two connection shafts of a subpart into two connection grooves in a body;

placing a cover plate onto the body to close the two connection grooves;

connecting the cover plate and the body fixedly;

wherein:

the automatic wobble jewelry apparatus comprises the body, the subpart arranged inside the body and a space arranged in the body for the subpart to wobble in the space;

the two connection shafts extending from each of two sides of the subpart;

the two connection grooves are formed in each of two inner sides of the body to receive the two connection shafts for connecting the subpart, each of the two connection grooves is formed in a C-shape having an opening, and a width of the opening is smaller than a diameter of each of the two connection grooves; and for each of the two connection grooves, a barrier sidewall is formed on one side of the connection groove at a position opposite to the corresponding connection shaft to limit a movement range of the subpart.

10. The automatic wobble jewelry apparatus setting method according to claim 9, wherein each of the two connection shafts comprises a first blade-shaped edge.

11. The automatic wobble jewelry apparatus setting method according to claim 10, wherein an end of each of the two connection shafts is formed as a tip.

12. The automatic wobble jewelry apparatus setting method according to claim 11, wherein a barrier part is formed at the opening of the C-shape.

13. The automatic wobble jewelry apparatus setting method according to claim 12, wherein the cover plate has a plurality of rings having a cutting face of inner and outer concentric circles.

14. The automatic wobble jewelry apparatus setting method according to claim 13, wherein the cutting face is a single-cutting face or a multi-cutting face.

15. The automatic wobble jewelry apparatus setting method according to claim 12, wherein a rear side of the body further has a through hole arranged for light transmission.

16. The automatic wobble jewelry apparatus setting method according to claim 12, wherein the body further has a pendant connection ring for connecting a necklace or a bracelet.

17. The automatic wobble jewelry apparatus setting method according to claim 9, wherein the step of connecting the cover plate and the body fixedly comprises welding the cover plate and the body by using a laser.

* * * * *